US005580125A

United States Patent [19]

Alger

[11] Patent Number: 5,580,125

[45] Date of Patent: Dec. 3, 1996

[54] CINEMA BOOSTER SEAT/REFRESHMENT CENTER

[75] Inventor: Allison M. Alger, Cincusnaveur, United Arab Emirates

[73] Assignee: The United States of America as represented by the Secretary of the Navy, Washington, D.C.

[21] Appl. No.: 521,386

[22] Filed: Aug. 15, 1995

[51] Int. Cl.[6] ..... A47C 1/08

[52] U.S. Cl. ..... 297/250.1; 297/183.5; 297/188.04; 297/382; 297/DIG. 6

[58] Field of Search ..... 297/DIG. 6, 378.1, 297/380, 250.1, 183.5, 183.1, 188.04, 452.17, 118, 124, 125, 129, 382

[56] References Cited

U.S. PATENT DOCUMENTS

| | | | |
|---|---|---|---|
| 2,364,050 | 12/1944 | Benson | 297/188.04 |
| 2,591,306 | 4/1952 | Sherman | 297/284.5 |
| 2,740,466 | 4/1956 | Du Priest | 297/183.5 |
| 2,775,999 | 1/1957 | Goodeve | 297/284.5 X |
| 3,032,916 | 5/1962 | Oakes | 297/183.5 X |
| 3,120,404 | 2/1964 | Bramming | 297/252 X |
| 3,817,574 | 6/1974 | McNab | 297/188.04 |
| 4,213,213 | 7/1980 | Burnett | 297/452.17 X |
| 5,042,875 | 8/1991 | Biggs, Jr. | 297/188.01 X |
| 5,421,637 | 6/1995 | Lemburg | 297/378.1 X |

*Primary Examiner*—Milton Nelson, Jr.

[57] ABSTRACT

A child theater seat for use in theaters having fold up seats spring loaded to the upright position whereby the weight of said child theater seat holds the underlining seat in the down position when in use. The child theater seat is hinged with a strap to keep it folded when not in use. The back of the child seat is recessed in correspondence to drinks and other concessions so that the folded seat becomes a carrier for snack bar items. The seat may be fitted with rails and dispensed from a coin operated rack in theater lobbies.

16 Claims, 5 Drawing Sheets

CINEMA BOOSTER SEAT/REFRESHMENT CENTER

ORIGIN OF THE INVENTION

The invention described herein was made by a member of the Armed Forces as represented by the United States Navy and may be manufactured, used, licensed by and for the Government for any governmental purposes without payment of any royalties thereon.

FIELD OF THE INVENTION

The present invention relates generally to the field of child booster seats and in particularly to those used in movie theaters.

BACKGROUND OF THE INVENTION

The invention is a booster chair for comfortably supporting young children in a movie theater having seats designed to support adults and biased to fold upward and inward with spring pressure when not in use.

The prior art is replete with child booster and safety seats for nearly all applications where a child is required to sit in seats designed for adults. Many inventions are concerned with automobiles and aircraft where proper seating is a safety concern. Examples of this application include U.S. Pat. No. 5,332,285 issued to Sinnhuber on Jul. 26, 1994 presenting a vehicle safety seat attaching to the vehicle seat and head rest. U.S. Pat. No. 5,286,086 issued to Gunji on Feb. 15, 1994 further teaches an auxiliary child seat for a vehicle with connections for the vehicle seat belts. Other child seats are taught for ordinary chairs such as U.S. Pat. No. 5,335,968 to Sheridan et al. issued Aug. 9, 1994, describing an inflatable unit, and for barber chairs such as U.S. Pat. No. 1,247,161.

Although this is a crowed art field, the area of child seating in stadiums and movie theaters is under-represented. One reference teaches a combination stadium seat and article carrier that is similar to a saddle bag with a cushioned flap to soften the hard bench type stadium seat. See, U.S. Pat. No. 2,865,433 issued Dec. 23, 1958 to Warner. Another reference teaches a bench type booster seat for suspension above the arm rests in a movie theater. As discussed in this U.S. Pat. No. 5,303,980 to Young issued Apr. 19, 1994, the current standard movie theater has seats with a depth designed for a normal sized adult and does not provide seats sized for children. Children using these adult seats often stand in them to gain enough height to see over the people seated in front of them.

Further taught in the above reference to Young is that standing in the adult seat by the child presents two problems. The first is that most adult theater seats are designed with a bias to spring the chair up and inward when the chair is not in use. Having a child standing in a chair that is biased upward and inward is unsafe because, for smaller children who lack the resistance to maintain the adult theater seat downward, the seat biases upward, possibly bending the child's legs and thus creating an uncomfortable viewing environment. The second problem that is created by a child standing in the theater seat is that the standing child is then generally taller than seated adult and hence restricts the viewing of the movie by theater patrons seated behind the child.

The last referenced patent above provides added height for the child by teaching a bench seat suspended across the arm rests of a movie seat. The bench is a solid planar surface that becomes uncomfortable for the child especially when considering the child must sit on the bench for extended periods of time to watch a complete movie. Another problem with the bench suspension seats is that the child's feet are free to constantly engage the spring biased movie theater seat creating noise as the spring seat is partially depressed and then released.

A bench seat is also difficult to carry to the theater especially with a child and the requisite drinks, pop corn, and sundry other items mothers take into a theater with their children.

SUMMARY OF THE INVENTION

Accordingly, an object of the present invention is to provide a child theater booster chair that can be used in an adult movie seat that uses the comfort of the existing movie seat by resting thereon.

Furthermore, an object of the instant invention is to teach a theater chair that can be folded and easily carried into the theater.

Another object of the invention taught herein is to provide a theater chair that can double as a concession carrier from the theater lobby to the movie seats by providing a surface recessed for carrying drinks, popcorn, etc.

Yet another object of the present invention is to disclose a theater booster chair that can be folded and rack mounted in a coin operated dispensing rack in a theater lobby.

In accordance with the present invention, a child theater booster chair is provided whereby the seat is hinged and foldable for easy transport and for dispensing from a coin operated rack in a theater lobby. The reverse of the seat back is recessed for holding drinks and other concessions on the way to theater seating. The seat cushion has weighted closure straps of sufficient weight to hold a spring biased theater seat in the down position when placed in the theater seat. While the name chosen for the invention implies a primary use in movie theaters, it is understood that the invention could be used in stadiums, briefing theaters, even fast food restaurants where food needs to be carried along with a child booster chair. The invention is designed for seats that have a spring biased seat cushion but most of the embodiments would function well on stationary or bench seats.

These and other more specific objects will appear upon reading the following specification and claims and upon considering in connection therewith the attached drawings to which they relate. The following drawings show, for purposes of illustration only, a single embodiment in accordance with the present invention.

BRIEF DESCRIPTION OF THE DRAWINGS

These drawings to which reference is expressly made for all individual features not explained below, elucidates the invention on the basis of examples. Shown are.

DETAILED DESCRIPTION OF THE DRAWINGS

Figure 1:
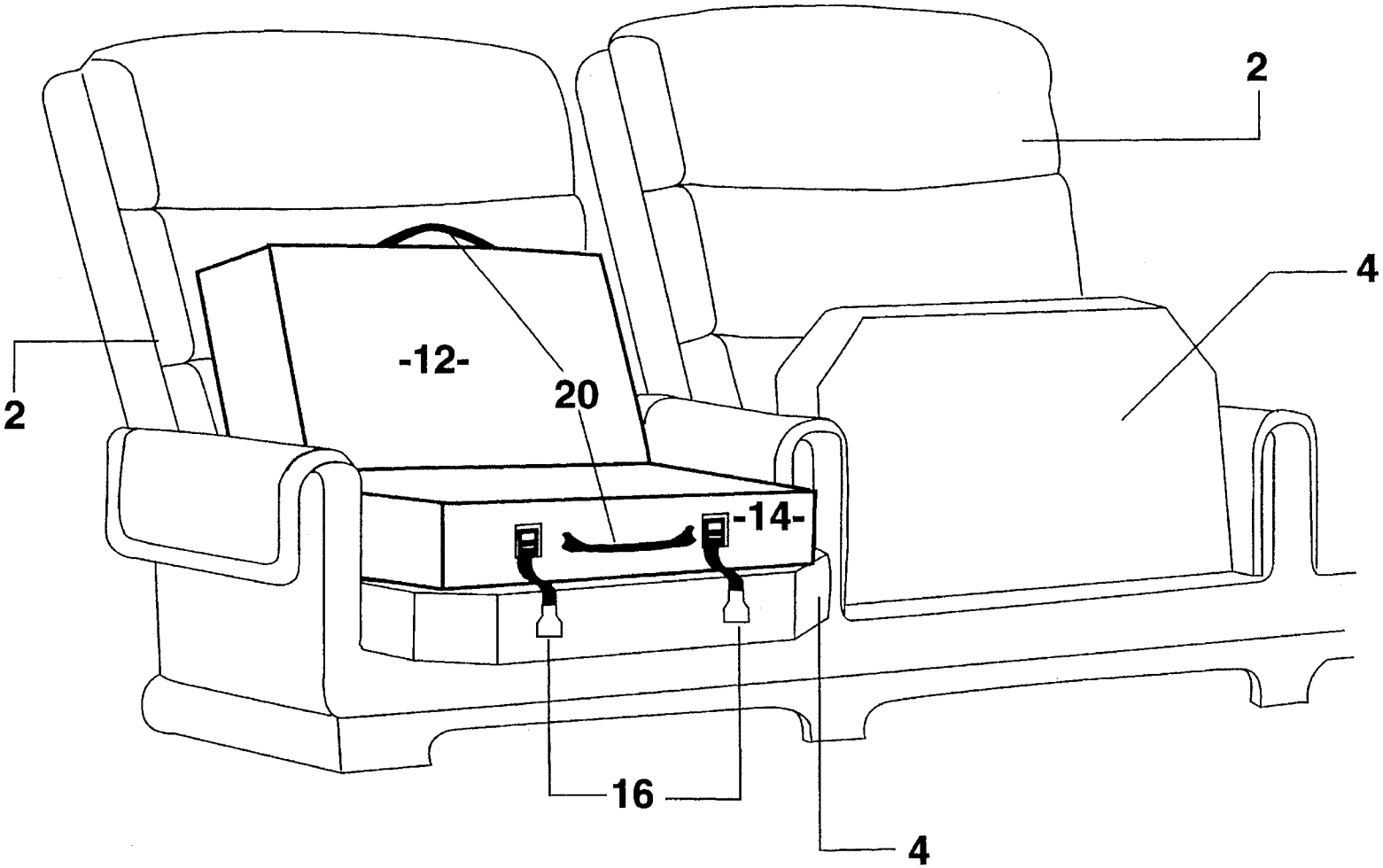
FIG. 1 a functional view of the invention operably installed in a movie seat.

Turning now to FIG. 1, the present invention may be viewed in the open position installed in a standard movie seat 2 having a spring biased seat cushion 4, biased to the up position. The instant invention 10 is shown installed in movie seat 2 in the open ready to use position. The child theater booster chair 10 of the present invention has a chair back 12 connected with a hinge to a chair bottom 14. Both the chair back 12 and the chair seat 14 are essentially planar structures and may be constructed of any material that is strong and light. While the construction materials are a design choice, a molded plastic is considered the best mode of construction for the chair back 12 and seat 14.

A pair of straps 16 contain a quantity of shot 18 that adds enough weight to the straps to keep the movie seat 4 in the down and open position while chair 10 is installed. The shot may be any small ball bearings or BB's and may be steel, copper-clad or lead. Because of the toxicity of lead it is considered to be the best mode to use a small steel shot approximately the size of an air rifle BB, although the gauge of shot is a design choice and imposes no limitations on the invention. Straps 16 are shown as two distinct separate straps but another embodiment can easily by constructed with a single weighted appendage 16. In the embodiment chosen for illustration, the weighted appendage is constructed from press and adhere material such as is marketed under the tradename Velcro®, so that it might engage a receiving material on the chair back 12 and hold the chair 10 in the folded, side by side position.

It is important to note that the embodiment chosen for illustration taught making weighted straps 16 out of press and adhere materials and filling them with shot 18, but the straps could contain snaps or buckles to engage the proper receiver on chair back 12 and have the weighted appendage as a separate element.

Figure 3:
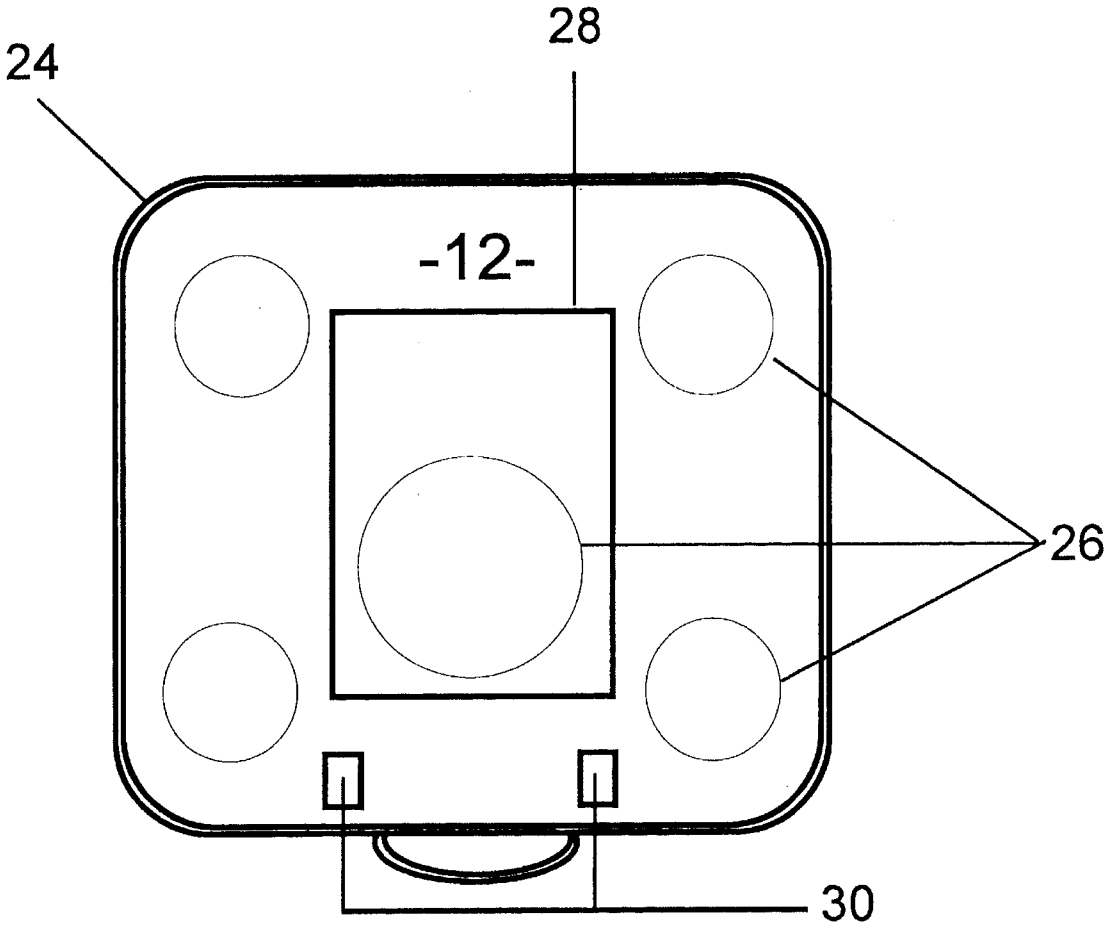
FIG. 3. is a top view of the chair back of the invention shown in FIG. 1. depicting one possible layout of the recesses used for carrying drinks and concessions.

Finally, FIG. 1, shows a pair of handles 20 that are curved handles of the type used on dresser drawers. Another type handle is shown in FIG. 3 constructed out of canvas material. The best mode is considered to be constructing both handles 20 and hinge 22 out of canvas material as it is soft and safe around small children and economical to build. Handles 20 are operatively mounted and cooperate as a single handle when the invention 10 is in the folded, side by side position, allowing the user to hold both handles in one hand while carrying the chair. The type of handles is not critical to the invention and the type and materials used in construction of handles 20 is considered a design choice.

Figure 2:
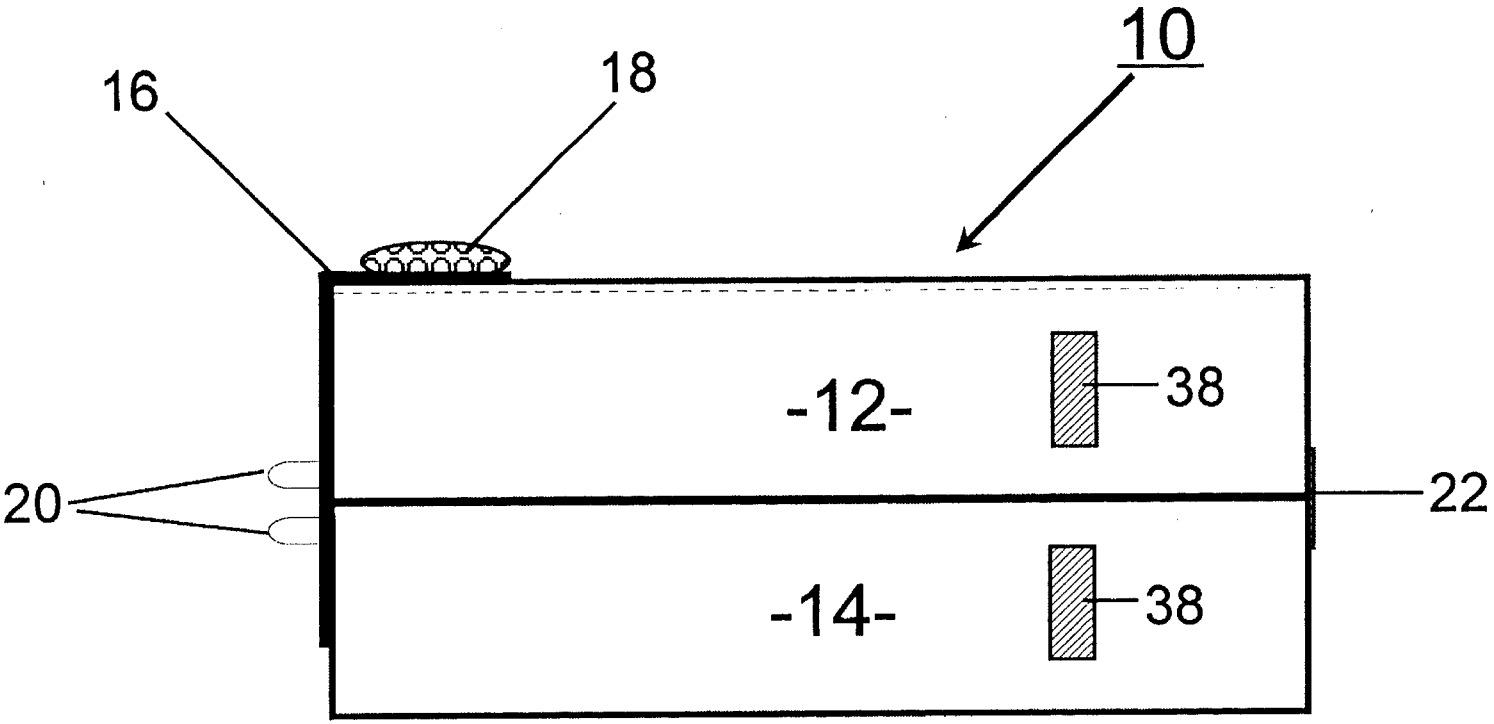
FIG. 2. is the invention shown in FIG. 1. folded into the storage and carry position.

FIG. 2 depicts the theater booster chair 10 in a folded, side beside position. A hinge 22 rotatably connects the chair back structure 12. FIG. 2 shows handles now in close proximity each to the other so that a person carrying chair 10 might use and hold them as a single handle.

FIG. 3 is a top view of the back of chair back structure 12 showing a two dimensional layout of possible recesses constructed into chair back structure 12 for carrying drinks and other concessions. The chair back 12 has a raised lip 24 around the outside edge so that when the chair is carried horizontally, it can also function as a carrying tray for whatever items need be carried into the theater. The raised lip need not be overly large and about one third of an inch works well. Within this raised lip 24 there is a plurality of circular depressions 26 sized for carrying drinks from the concession stand to the movie seats. The embodiment chosen for illustration also has a square indentation 28 that is operatively sized so that a box of popcorn will fit into depression 28. The depths of the recessions are a design choice but in the prototype testing, one half to one inch works well.

FIG. 3 also shows two patches of Velcro type receiving material 30 for attachably engaging the weighted closure straps 16, show in FIG. 1, to keep invention 10 in the folded, side by side carrying position.

Figure 4:
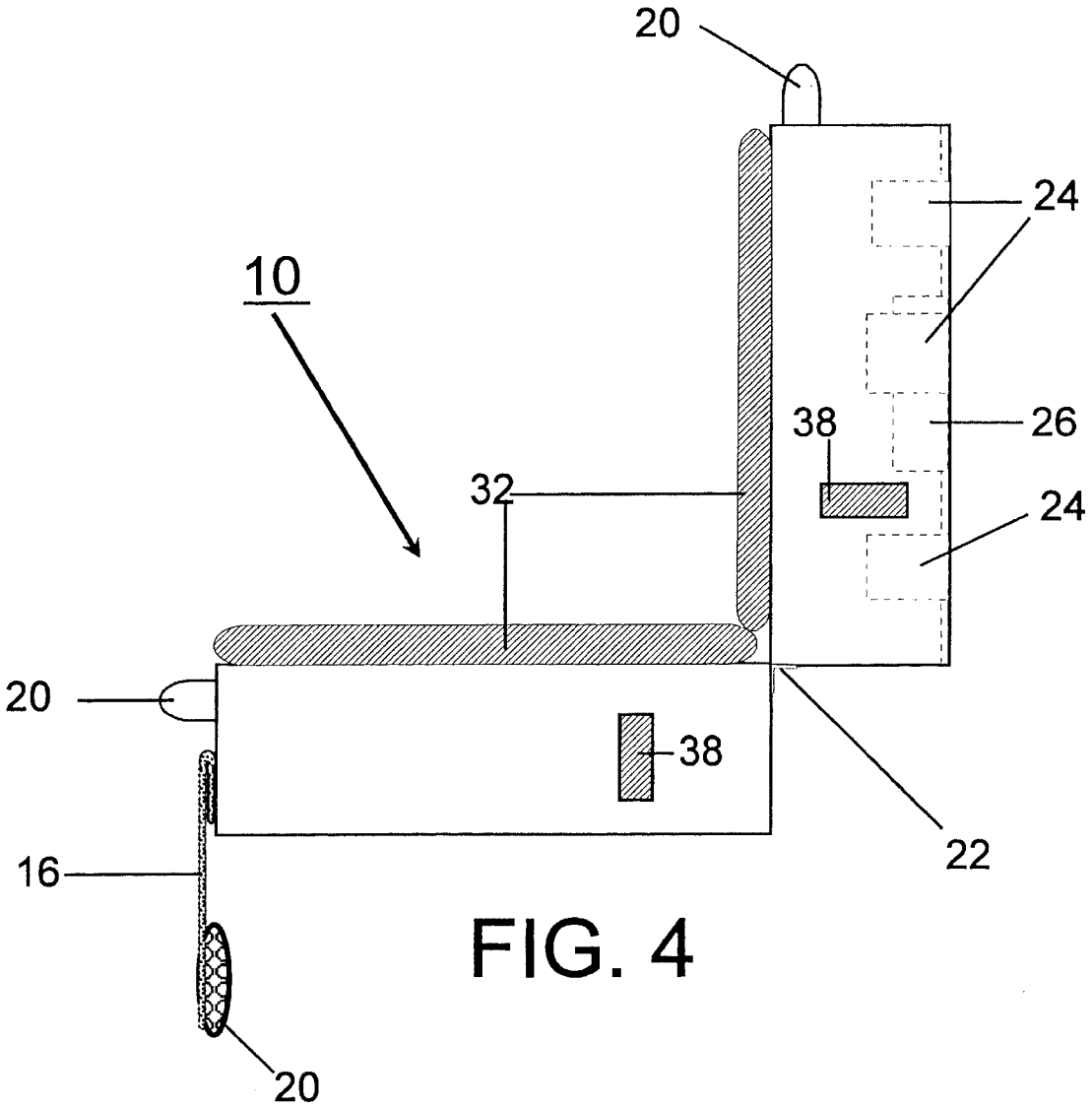
FIG. 4. is a side view of the invention of FIG. 1.

FIG. 4 is a side view of invention 10 showing the recessed indentations 24 and 26 in phantom. A pair of cushions 32 are shown attached to the booster chair back and seat. These cushions may be attached with any appropriate fastening methods, such as snaps or adhesive.

Figure 5:
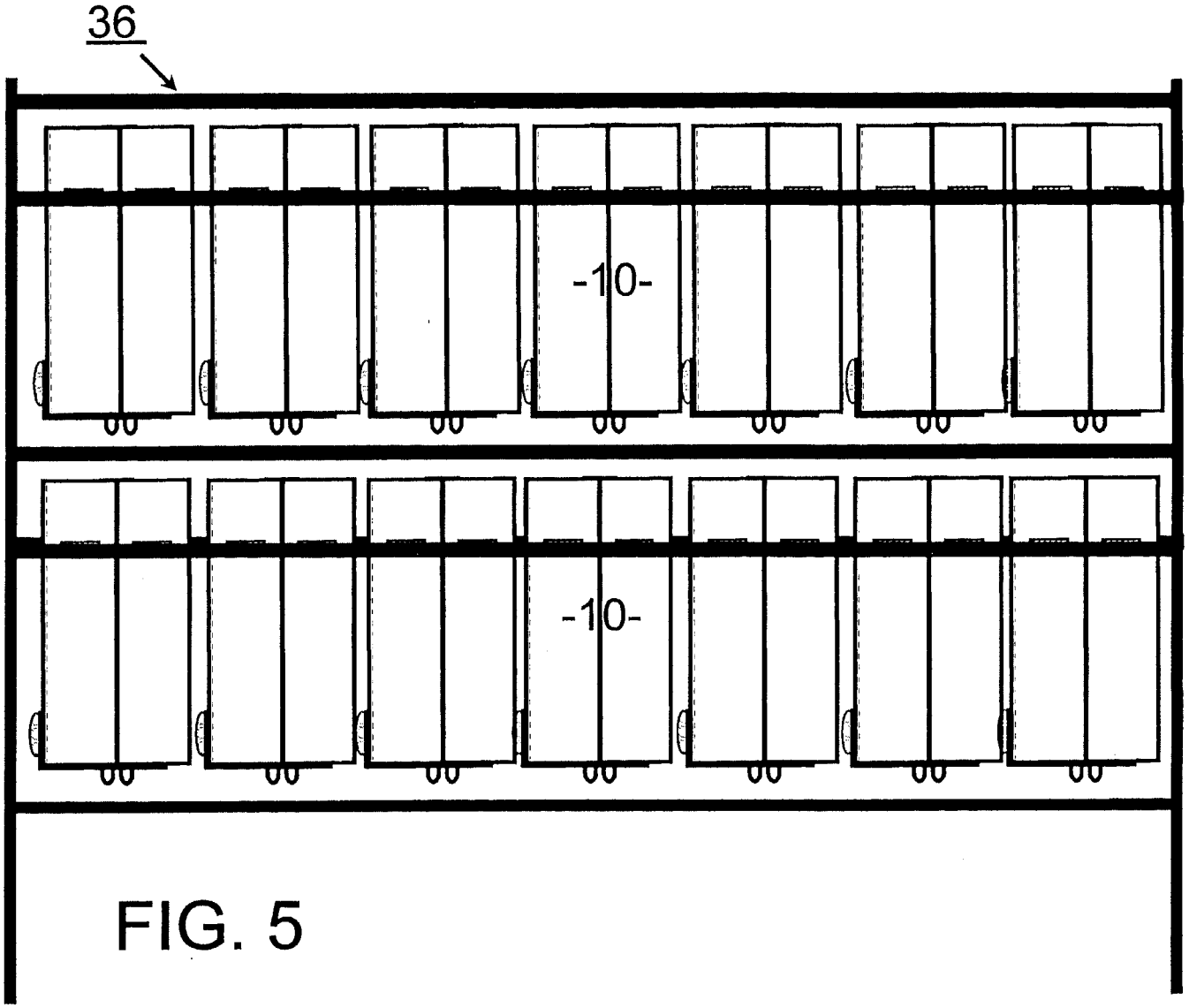
FIG. 5. depicts a series of invention 10 mounted in a dispensing rack.

FIG. 5 shows a number of the child theater booster chairs mounted in a dispenser rack 36, for dispensing in a movie theater lobby. The dispensing rack might be of the type that dispenses baggage carts at major airports and there are many existing designs that incorporate a coin type arrangement. It is considered to be within the scope of this invention to design rails 38 to allow the invention to be commercially dispensed in appropriate dispensing racks.

Thus, although the invention has been described relative to a specific embodiment thereof, there are numerous variations and modifications that will be readily apparent to those skilled in the art of the above teachings. It is therefore to be understood that, within the scope of the appended claims, the invention may be practiced other than as specifically described.

What is claimed as new and desired to be secured by Letters Patent of the United States is:

1. A child theater booster chair comprising:

a first planar structure; and a second planar structure; and a hinge connecting said first and said second planar structure whereby said first and said second planar structures may be folded into side by side folded relationship when not in use or opened with said first and said second planar structures in essentially perpendicular relationship configuring the child theater booster chair for placement into an open movie seat; and a bifurcated weighted appendage forming a pair of shot filled straps attached to said second planar structure operatively sized to hold a spring biased movie seat in an open position while the child theater booster chair is installed in a movie seat; and a pair of press and release type material sections attached to the pair of shot filled straps forming said bifurcated appendage; in cooperation with a pair of press and release type receiving patches operatively spaced on said first and said second planar structure whereby said first and said second planar structure can be held in a folded position with said bifurcated weighted appendage.

2. A child theater booster chair according to claim 1 wherein the weight in said bifurcated weighted appendage essentially comprises steel BBs.

3. A child theater booster chair according to claim 1 wherein said first planar structure has a plurality of recessed indentations extending partially into said first planar structure whereby drinks and other concessions might be placed in the recessed indentations for carrying when the child theater booster chair is in a folded position.

4. A child theater booster chair according to claim 1 further defined by a pair of rails mounted on the booster seat for slidingly engaging a dispenser rack for holding and dispensing the child theater booster chair.

5. A child theater booster chair according to claim 1 further defined by cushion material affixed to each of said first and said second planar structures forming a back and seat cushion respectively, for a child using the child theater booster chair.

6. A child theater booster chair according to claim 1 wherein said hinge is a strip of canvas.

7. A child theater booster chair comprising:

a first planar structure; and a second planar structure; and a hinge connecting said first and said second planar structure whereby said first and said second planar structures may be folded into side by side folded relationship when not in use or opened with said first and said second planar structures forming a seat back and a seat respectively, in essentially perpendicular relationship, creating a child theater booster chair for placement into an open spring biased movie seat; and a bifurcated weighted appendage forming a pair of shot filled straps attached to said second planar structure operatively sized whereby a spring biased movie seat may be held in an open position while the child theater booster chair is installed in a spring biased movie seat; and a pair of press and release type material sections attached to the pair of shot filled straps forming said bifurcated appendage; in cooperation with a pair of press and release type receiving patches operatively spaced on said first and said second planar structure whereby said first and said second planar structure can be held in a folded position with said bifurcated weighted appendage, and a pair of handles operatively affixed to the child theater booster chair for ease of handling.

8. A child theater booster chair according to claim 7 wherein said first planar structure has a plurality of recessed indentations extending partially into said first planar structure whereby drinks and other concessions might be placed in the recessed indentations for carrying, when the child theater booster chair is in a folded position.

9. A child theater booster chair according to claim 7 further defined by a pair of rails mounted on the booster seat for slidingly engaging a dispenser rack for holding and dispensing the child theater booster chair.

10. A child theater booster chair according to claim 7 further defined by cushion material affixed to each of said first and said second planar structures forming a back and seat cushion respectively, for a child using the theater booster chair.

11. A child theater booster chair according to claim 7 wherein said hinge is a strip of canvas.

12. A child theater booster chair according to claim 7 wherein the weight in said bifurcated weighted appendage essentially comprises steel BBs.

13. A child theater booster chair in accordance with claim 7 wherein said pair of handles comprises a pair of curved dresser drawer style handles.

14. A child theater booster chair according to claim 13 wherein the weight in said bifurcated weighted appendage essentially comprises steel BBs.

15. A child theater booster chair comprising;

a first planar structure having a back side containing a plurality of recessed indentations for holding drinks and other concessions, a top end, a child seating side, a hinged end; and a second planar structure having a child seating side, a hinged end, a top end; and a hinge affixing said first and said second planar structures together at the hinged ends whereby the child booster chair may be folded with the child seating sides of said first and said second planar surfaces in adjacent relationship; and a pair of curved handles mounted on the top end of said first planar structure and said second planar structure, operatively spaced so that said pair of curved handles can be grasped as one when the child theater booster chair is in a folded position; and a pair of shot filled weighted straps fabricated of press and release type material mounted to the top of said second planar structure; in cooperation with a pair of press and release type material patches attached to the top end of said first planar structure whereby said first planar structure and said second planar structure can be held in a folded position; and a pair of cushions attached to the child seating sides of said first and said second planar structures.

16. A child theater booster chair according to claim 15 further defined by a pair of rails mounted on each of the outside edges of said first and said second planar surfaces for slidingly engaging a dispenser rack.

* * * * *